US005567086A

United States Patent [19]

Huete

[11] Patent Number: 5,567,086

[45] Date of Patent: Oct. 22, 1996

[54] TENSION LEG CAISSON AND METHOD OF ERECTING THE SAME

[75] Inventor: David A. Huete, Spring, Tex.

[73] Assignee: Shell Oil Company, Houston, Tex.

[21] Appl. No.: 370,766

[22] Filed: Dec. 23, 1994

[51] Int. Cl.[6] ..... E02D 23/00

[52] U.S. Cl. ..... 405/223.1; 405/200; 405/205

[58] Field of Search ..... 405/223.1, 200, 405/205

[56] References Cited

U.S. PATENT DOCUMENTS

| | | | |
|---|---|---|---|
| 3,540,396 | 11/1970 | Horton | 405/223.1 X |
| 3,577,946 | 5/1971 | Horton | 114/0.5 |
| 3,934,528 | 1/1976 | Horton et al. | 114/0.5 D |
| 3,982,492 | 9/1976 | Steddum | 114/0.5 D |
| 3,996,755 | 12/1976 | Kalinowski | 114/265 X |
| 4,114,393 | 9/1978 | Engle, Jr. et al. | 114/264 |
| 4,198,179 | 4/1980 | Pease et al. | 405/195 |
| 4,320,993 | 3/1982 | Hunter | 405/224 |
| 4,421,436 | 12/1983 | Burns | 405/60 |
| 4,423,985 | 1/1984 | Aagaard | 405/224 |
| 4,437,794 | 3/1984 | Grimsley et al. | 405/224 |
| 4,895,481 | 1/1990 | Pepin-Lehalleur et al. | 405/223.1 |
| 5,190,411 | 3/1993 | Huete et al. | 40/223 |
| 5,195,848 | 3/1993 | Huete et al. | 405/202 |
| 5,199,821 | 4/1993 | Huete et al. | 405/202 |
| 5,342,148 | 8/1994 | Huete et al. | 405/223.1 |
| 5,421,676 | 6/1995 | Wybro et al. | 405/223.1 |
| 5,423,632 | 6/1995 | Ekvall et al. | 405/223 |
| 5,439,324 | 8/1995 | Ekvall et al. | 405/202 |

*Primary Examiner*—Michael Powell Buiz
*Assistant Examiner*—Tara L. Mayo
*Attorney, Agent, or Firm*—Mark A. Smith

[57] ABSTRACT

A tension leg caisson is disclosed for supporting surface facilities on a deck for conducting hydrocarbon recovery operations in deepwater location applications. The tension leg caisson has an elongated, buoyant central vertical column or caisson with a plurality of outrigger pontoons. A plurality of tendons are connected on one end to the outrigger pontoons at a location which is spaced apart from the vertical. The other end is anchored to the ocean floor. Another aspect of the invention is a method of improving the dynamic response of a buoyant central caisson type platform.

15 Claims, 5 Drawing Sheets

FIG. 1
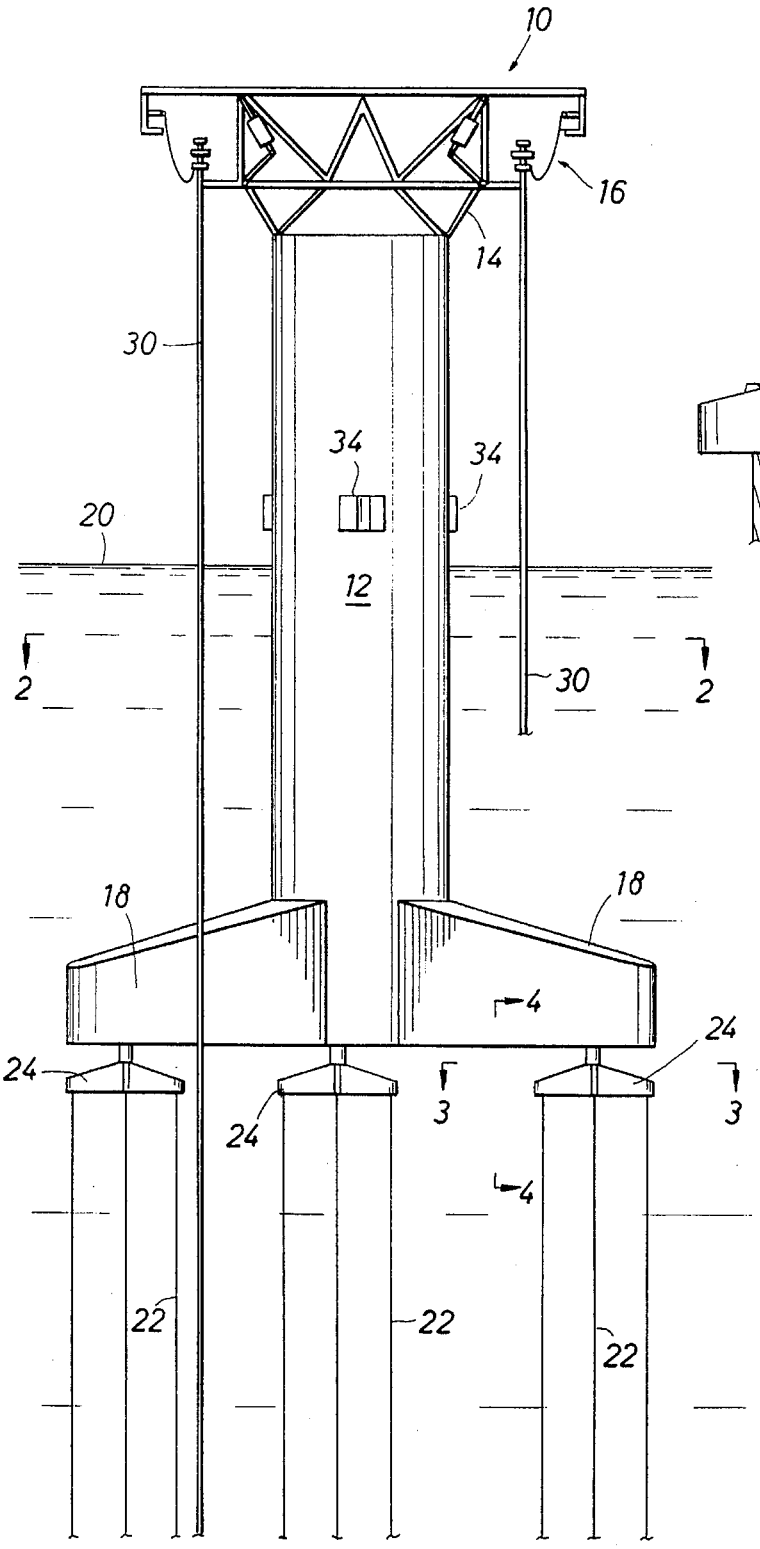
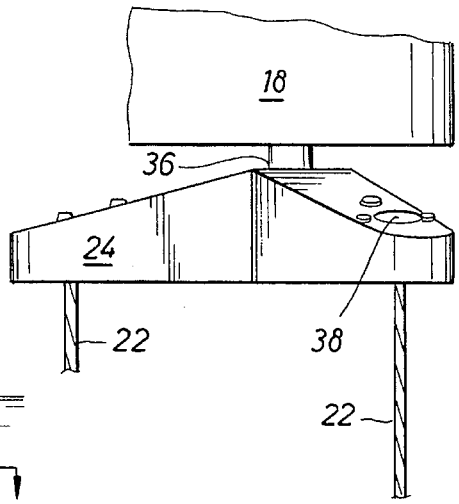
FIG. 4

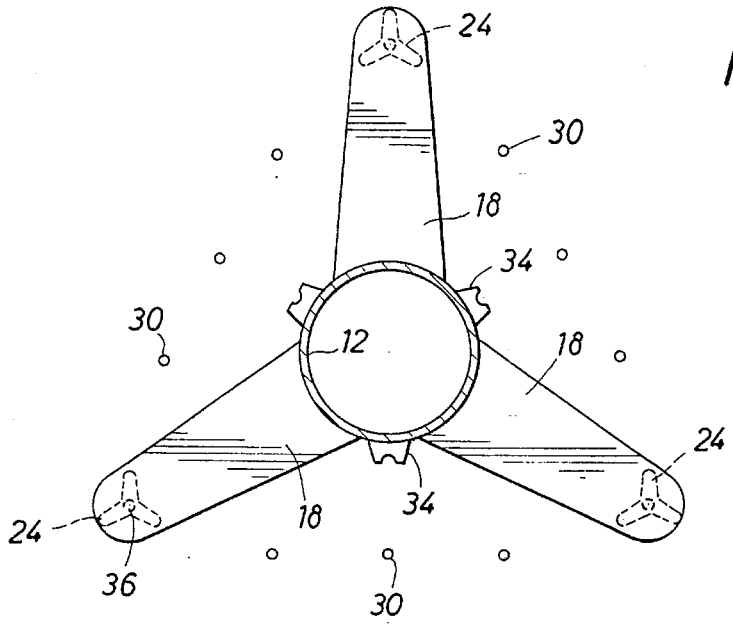
FIG. 2
FIG. 3
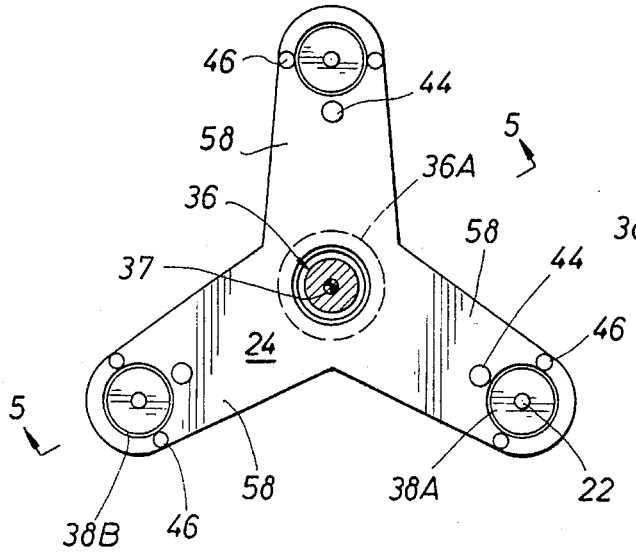
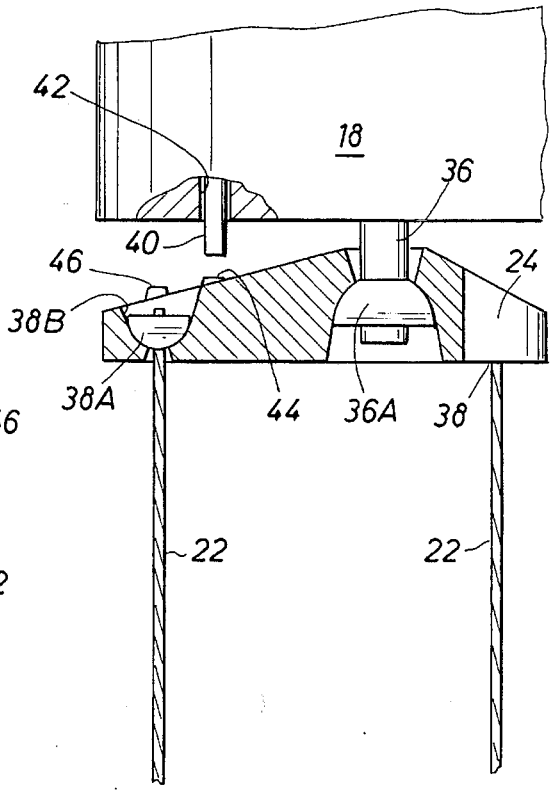
FIG. 5

TENSION LEG CAISSON AND METHOD OF ERECTING THE SAME

BACKGROUND OF THE INVENTION

The present invention relates to deepwater offshore platforms. More particularly, it relates to single caisson, tethered structures.

Small, minimum-capability platforms have several advantages over large, full-capability platforms in the development of hydrocarbon reserves in deep water. A much lower capital cost is one of the significant advantages. However, minimizing platform capability by eliminating a resident drilling rig and other useful equipment from the design also significantly limits the ability of the platform to adapt to new reservoir and/or economic information suggesting changes in the development scenario. The Tension Leg Well Jacket (TLWJ) concept was developed to address this limitation. In the TLWJ concept, a small tension leg platform on "TLP" (the TLWJ, mini-spar or other minimal structure) supports the wells for surface accessible completions, but drilling and other major well operations are performed by a semisubmersible drilling rig which docks to or is otherwise restrained adjacent the TLWJ. This method of conducting well operations is more fully discussed in U.S. Pat.No. 5,199,821, issued Apr. 6, 1993to D. A. Huete et al for a Method for Conducting Offshore Well Operations and U.S. patent application Ser. No. 024,584, filed by A. G. C. Ekvall et al on Mar. 1, 1993 for a Bumper Docking Between Offshore Drilling Vessels and Compliant Platforms, the disclosures of which are hereby incorporated by reference and made a part hereof.

It is understood that the smaller the floating platform, i.e. , the smaller the total hull displacement, the cheaper it is. Although the size of the floating platform is mostly determined by the topsides payload demand and the number of production wells to be supported, there is a point below which the traditional rectangular hull having four coner columns connected at the keel with four horizontal pontoons is no longer an optimal configuration. Revised configurations that support the same amount deck load with shorter deck spans have cost advantages for such minimal configurations. Single column type designs have been developed to serve this need, including monopod and mini-spars, which provide the logically smallest floating platform that is moored with one or more vertical tension members.

A difficulty with the monopod and mini-spar designs are that they tend to roll and pitch (rotate about two horizontal axes), although restrained in heave (vertical motion) by the tendons. The pitch and roll responses of a monopod are troublesome because of fatigue problems in the tendons due to bending, and because of potential interference with well risers which may be arranged outside the column.

SUMMARY OF THE INVENTION

An advantage of the present invention is that it takes advantage of the minimal hull of a monopod or mini-spar, but with improved dynamic response. The improved dynamic response reduces the fatigue effects on the tendons and protects the production risers.

Toward the fulfillment of these and other advantages, the present invention provides a tension leg caisson supporting surface facilities on a deck for conducting hydrocarbon recovery operations in deepwater applications. The tension leg caisson has an elongated, buoyant central vertical column or caisson with a plurality of outrigger pontoons. A plurality of tendons are connected on one end to the outrigger pontoons at a location which is spaced apart from the vertical column. The other end is anchored to the ocean floor.

In an other aspect of the present invention, a method of improving the dynamic response of a buoyant central caisson type platform is established. A plurality of three or more outrigger pontoons are provided extending radially outward from the base of the caisson. A plurality of tendons are anchored to the ocean floor, substantially vertically aligned with the desired nominal position for the outrigger pontoons of the installed platform, and one or more tendons are connected to each of the outrigger pontoons at positions which are substantially equidistant from the caisson.

A BRIEF DESCRIPTION OF THE DRAWINGS

The brief description above, as well as further features and advantages of the present invention will be more fully appreciated by reference to following detailed description of illustrative embodiments which should be read in conjunction with the accompanying drawings in which:

FIG. 1 is a side perspective view of a tension leg caisson in one embodiment of the present invention;

FIG. 2 is a cross-sectional view of the tension leg caisson of FIG. 1 taken along line 2—2 in FIG. 1;

FIG. 3 is a partially cross-sectional top elevational view of a tribrach and the tendon cluster deployed in the tension leg caisson of FIG. 1, taken along line 3—3 in FIG. 1;

FIG. 4 is side elevational view of the tribrach and tendon cluster of FIG. 3, taken along line 4—4 in FIG 1;

FIG. 5 is a partially cross-sectioned side view of the tribrach and tendon cluster of FIG. 4;

DETAILED DESCRIPTION OF SELECTED EMBODIMENTS

Figure 6:
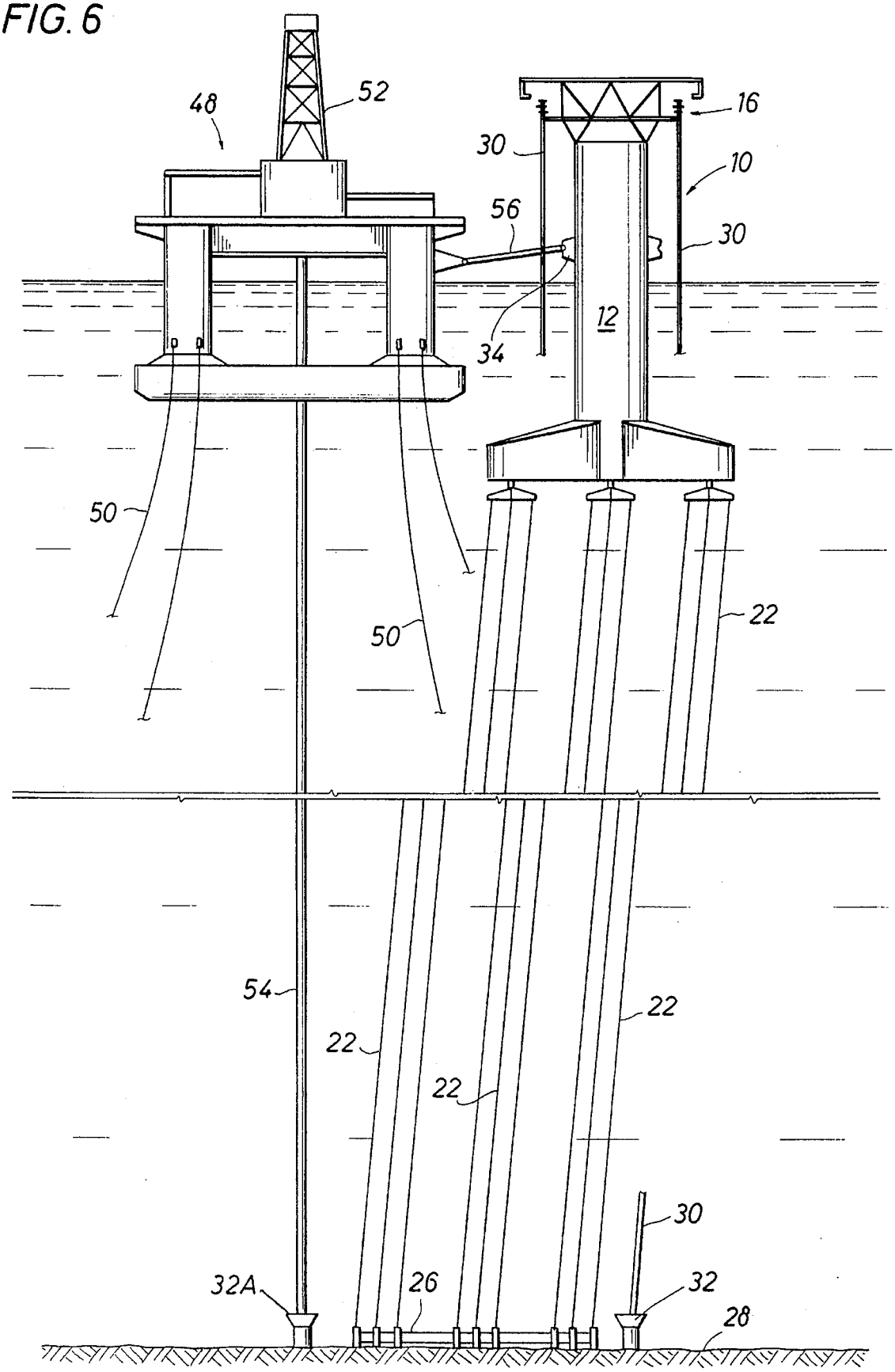
FIG. 6 is a side elevational view of a tension leg caisson accepting drilling operations from a semisubmersible drilling rig.

FIG. 1 illustrates one embodiment of a tension leg caisson 10 in body of water 20. The tension leg caisson has an elongated buoyant central caisson or vertical column 12 supporting a deck 14 with surface facilities 16. A plurality of three or more outrigger pontoons 18 project radially from the base of central caisson 12 in a horizontal plane. The stability of tension leg caisson 10 may be enhanced by taking on ballast in pontoons 18.

A plurality of tethers or tendons 22 anchor the tension leg caisson to the ocean floor (not shown) and draw it down below its free floating draft to limit heave response. Tendons 22 are connected to the outrigger pontoons at substantially equal distances from central caisson 12. In this embodiment, tendons 22 are clustered at tribrachs 24, each connected to one of outrigger pontoons 18. The bottoms of tendons 22 are connected to foundation 26 which is secured to ocean floor 28 by conventional means such as piles. See FIG. 6.

Returning to FIG. 1, a plurality of production risers 30 connect surface facilities 16 with wells 32 on ocean floor 28 for production operations. Drilling operations may be conveniently provided on a temporary basis by a semisubmersible rig. Refer again to FIG. 6. Provisions are made to receive the drilling facilities with a plurality of semisubmersible rig docking strut receptacles 34.

FIG. 2 illustrates the arrangement in this embodiment of pontoons 18, tendons 22, tendon clusters at tribrachs 24, production risers 30, and strut docking receptacles 34 about central caisson 12. Spreading the tribachs apart on the outrigger pontoons serves to the limit roll and pitch of the tension leg caisson. Ballasting the pontoons further limits this response.

FIGS. 3, 4 and 5 illustrate tribrach 24 and clusters of tendons 22. FIG. 4 is a close up of the substantially planar, horizontally disposed tendon bracket or tribrach 24. Tribrach 24 depends from the platform superstructure at outrigger pontoon 18 through a tendon bracket connection 36. The partially broken away view of FIG. 5 illustrates tendon bracket connection 36 in greater detail. Here, the tendon bracket connection is a hemispherical flexjoint 36A which is a steel and elastomeric laminated joint, but other connection allowing pivotal action could be used. FIG. 5 also illustrates an upper tendon connection 38 in which a termination fixture 38A is secured to tendon 22. In the illustrated embodiment, termination fixture 38A is also a hemispherical flexjoint. See also the top view of FIG. 3.

FIG. 5 also introduces the use of installation and leveling jack 40 disposed to project from pontoon 18 through access hole 42. A jack foot 44 is presented on tribrach 24 where the jack will engage. Failure stops 46 are also illustrated in FIGS. 3 and 5. The use of these features will be discussed in greater detail in connection with FIGS. 7A–7D.

FIG. 6 illustrates the use of the present invention in the method of conducting offshore well operations disclosed U.S. Pat. No. 5,199,821, referenced above. Semisubmersible drilling vessel 48 docks through strut 56 to tension leg caisson 10 at strut receptacle 34 on vertical column 12. Mooring lines 50 from vessel 48 are then adjusted to bring derrick 52 in line for conducing drilling operations for well 32A through a substantially vertical drilling riser 54. In this embodiment, achieving this alignment will temporarily bias tension leg caisson 10 out of its normal position centered over foundation 26. After a well is drilled, a production riser 30 is run to the well and attached to surface facilities 16 on the platform. Additional wells are drilled by repeating the process.

Figure 7A:
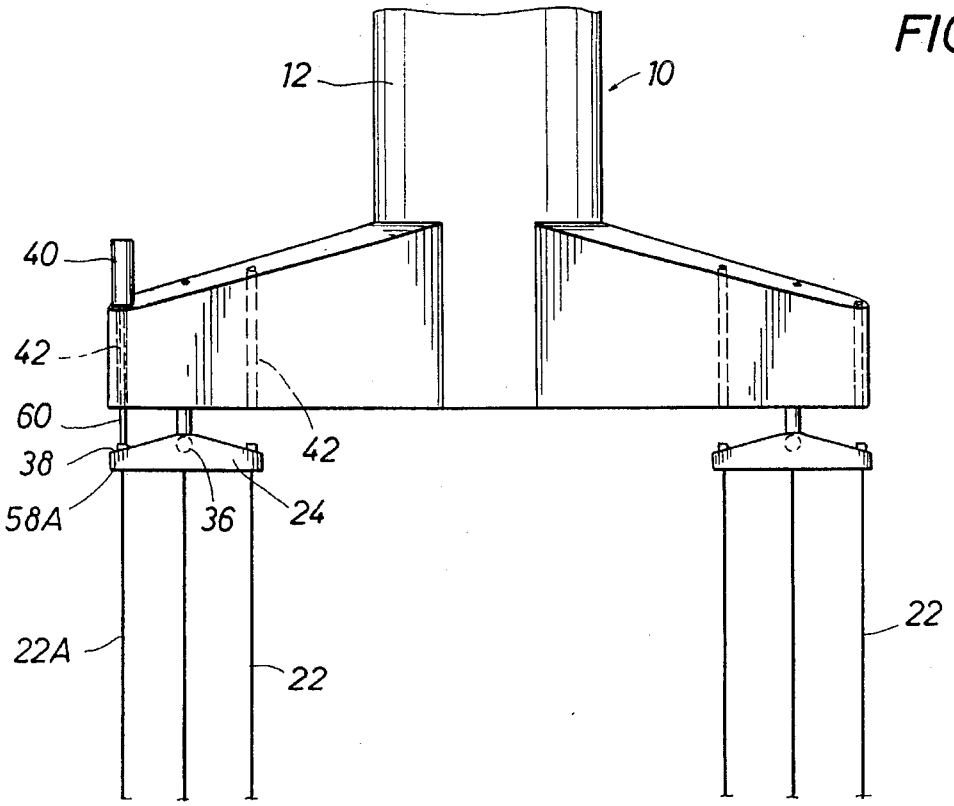
FIGS. 7A–7D illustrate tendon installation, normal deployment, failure mode and leveling compensation, respectively, in the use of tribrach and tendon clusters in a tension leg caisson.

FIGS. 7A–7D schematically illustrate the use of tendon bracket or tribrach 24 in clusters of tendons 22, preferable in groups of three tendons each. FIG. 7A illustrates use of jack 40 in the installation of a tendon. Jack 40 is connected to outrigger pontoon 18 and disposed to project its rod 60 through access hole 42 and against a lobe 58 of tribrach 24 at which a given tendon 22 is to be installed. Hydraulically extending rod 60 will, in a three tendon cluster, drive lobe 58A downward. This will provide greater access to upper tendon connection 38 and provide some slack facilitating secure and tight installation of termination fixture 38A about tendon 22A. See also FIG. 5.

Figure 7B:
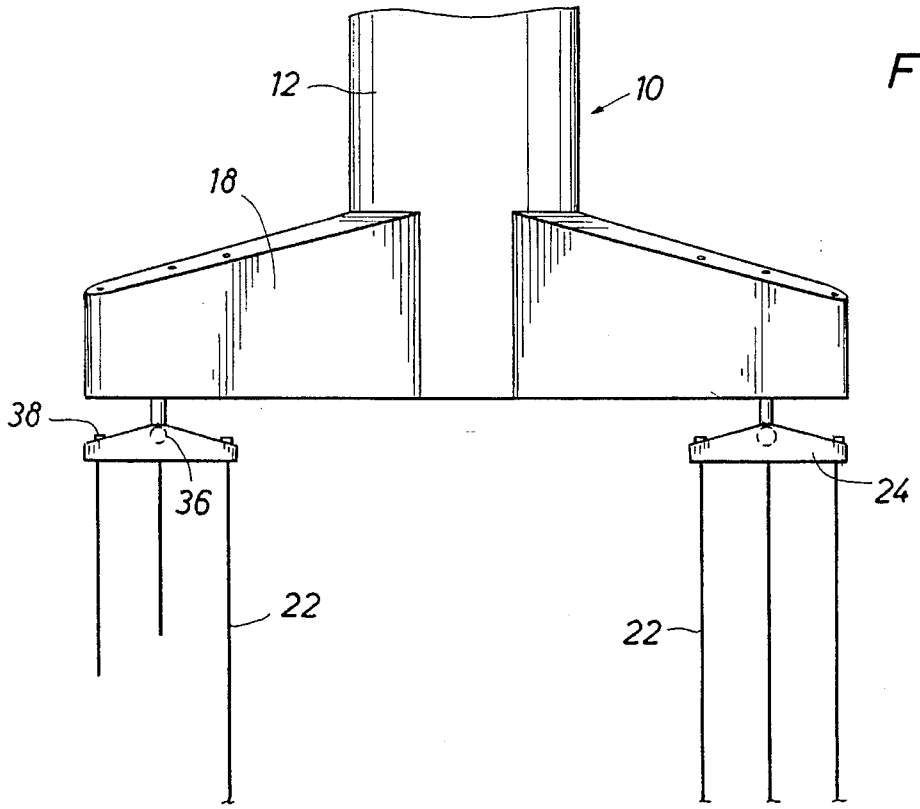
Figure 7C:
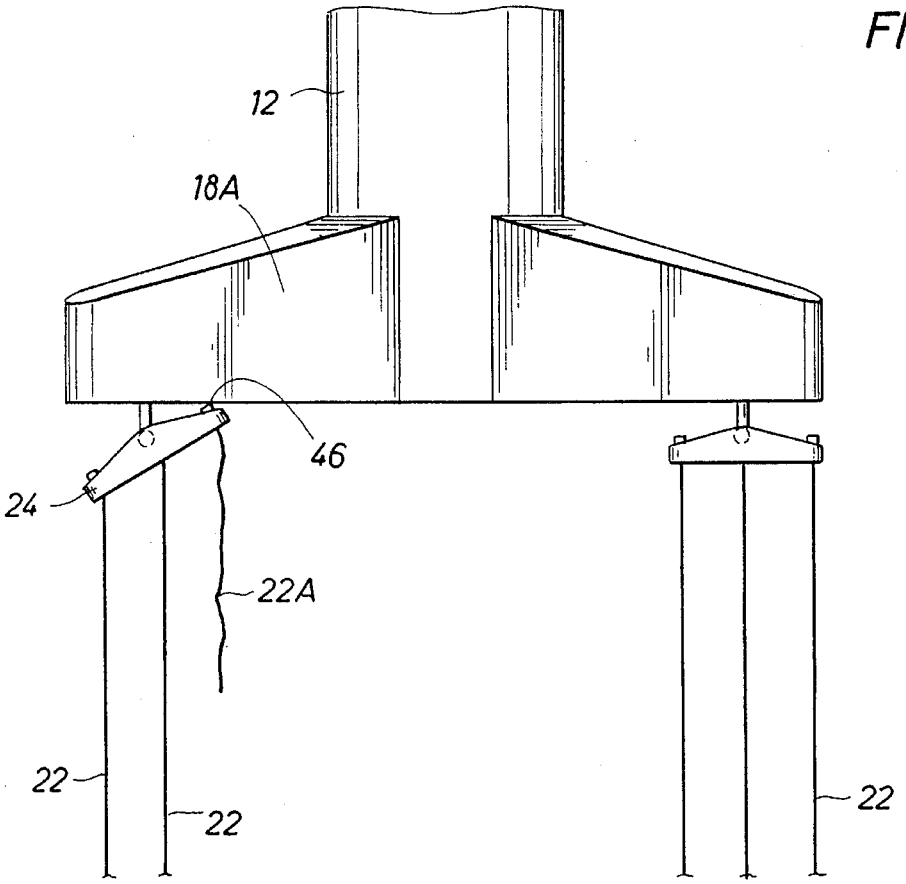
Figure 7D:
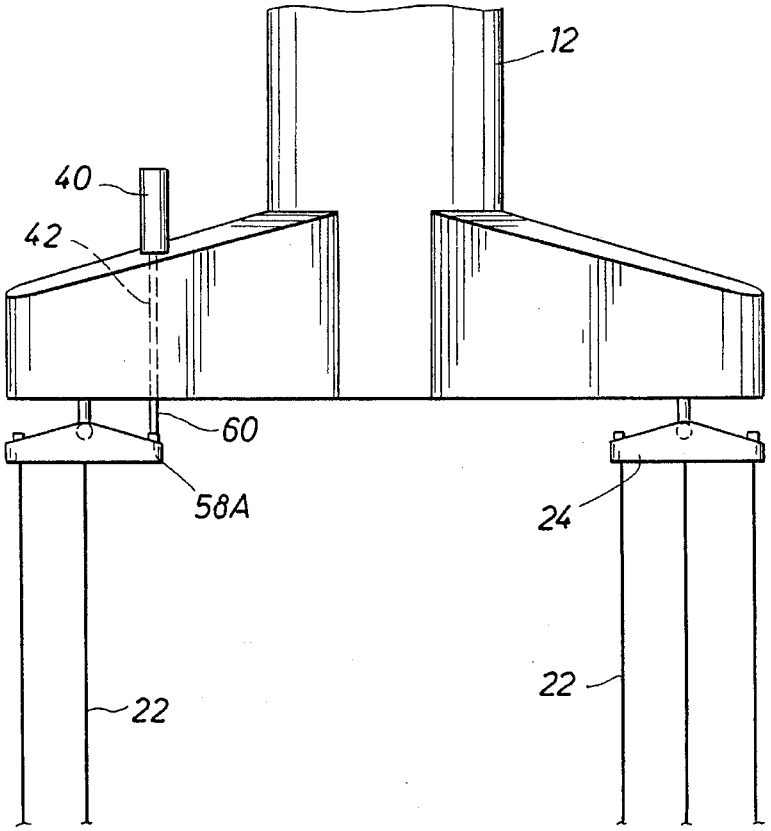

FIG.7B illustrates the use of tendon clusters and tendon brackets at normal trim, with each of tendons 22 sharing the load in its tendon cluster. By contrast, FIG. 7C illustrates failure mode in which one of tendons 22, here tendon 22A has parted. This causes tribrach 24 to pivot about tendon bracket connection 36, brings failure stop 46 into contact with the bottom of outrigger pontoon 18A and redistributes the load among the remaining tendons.

Pivoted, the tendon bracket contributes to the effective length of the remaining tendon and may cause the platform to perceptibly tilt as pontoon 18A rises. This provides notice that one of the tendons has failed and provides an opportunity to attend to repairs promptly. Alternatively, instrumentation could indicate contact of the pontoon and the failure stop. Jack 40 is also useful in leveling the platform by pushing down lobe 58A until a new tendon is available and ready for installation procedures. See FIG. 7D.

It should be appreciated that the tendon bracket/tendon cluster combination facilitates the use of wire rope or other unconventional, non-tubular tendon applications in which less expensive materials and fabrication techniques can be used in greater confidence by effectively distributing the load and having positive confirmation in the event of a partial (one tendon of cluster) failure in the redundant tendon cluster array.

The configuration described herein is statically determinate, in that loads in the tendons will be apportioned according to where they are connected to the caisson, and are independent of the elasticity of the tendons themselves. While remaining substantially horizontal, the tribrach will pivot to distribute this load evenly. This feature provides the benefit of simplifying tendon installation compared to conventional TLPs, as complex ballasting and tendon tensioning operations are not required.

A number of variations have been disclosed for employing the present invention. However, other modifications, changes and substitutions are intended in the foregoing disclosure. Further, in some instances, some features of the present invention will be used without a corresponding use of other features described in these illustrative embodiments. Accordingly, it is appropriate that the appended claims be construed broadly and in a manner consistent with the spirit and scope of the invention herein.

What is claimed is:

1. A tension leg caisson for providing surface facilities for conducting hydrocarbon recovery operations from the ocean floor from a deepwater location, comprising:

an elongated, buoyant central caisson;

a deck supported by the central caisson;

a plurality of production risers extending from the ocean floor to the surface facilities, running external to the central caisson;

three outrigger pontoons connected at the lower end of the central caisson and projecting radially outward therefrom in a horizontal plane; and a plurality of tendons, each connected on one end to one of the outrigger pontoons at a position spaced substantially equidistance from the central caisson.

2. A tension leg caisson in accordance with claim 1 wherein the outrigger pontoons are ballasted.

3. A tension leg caisson in accordance with claim 1 further comprising a plurality of semisubmersible rig docking strut receptacles connected to the center caisson.

4. A tension leg caisson for providing surface facilities for conducting hydrocarbon recovery operations from the ocean floor from a deepwater location, comprising:

an elongated, buoyant central vertical column;

a deck supported by the central vertical column;

a plurality of outrigger pontoons connected to the central vertical column; and a plurality of tendons, each connected on one end to one of the outrigger pontoons at a location spaced apart from the vertical column and anchored to the ocean floor on the other end.

5. A tension leg caisson in accordance with claim 4 wherein the outrigger pontoons project radially outwardly from the central vertical column.

6. A tension leg caisson in accordance with claim 5 wherein there are three outrigger pontoons.

7. A tension leg caisson in accordance with claim 6 wherein the central vertical column is substantially cylindrical.

8. A tension leg caisson in accordance with claim 7 wherein the outrigger pontoons are connected to the central vertical column at the base of the central vertical column.

9. A tension leg caisson in accordance with claim 8 wherein the outrigger pontoons are ballasted.

10. A tension leg caisson in accordance with claim 4 further comprising a plurality of semisubmersible rig docking strut assemblies.

11. A tension leg caisson in accordance with claim 10 wherein there are three outrigger pontoons, each projecting radially outwardly from the central vertical column.

12. A tension leg caisson in accordance with claim 11 wherein the central vertical column is substantially cylindrical caisson.

13. A tension leg caisson in accordance with claim 12 wherein the outrigger pontoons are connected to the caisson at the base of the central vertical column and are ballasted.

14. A method of providing a buoyant central caisson type platform with improved dynamic response, comprising:

providing a plurality of three or more outrigger pontoons extending radially outward from the base of the caisson;

anchoring a plurality of tendons to the ocean floor, substantially vertically aligned with the desired nominal position for the outrigger pontoons of the installed platform;

connecting one or more tendons to each of the outrigger pontoons at positions which are spaced substantially equidistantly away from the caisson.

15. A method of providing a buoyant central caisson type platform with improved dynamic response in accordance with claim 14, further comprising ballasting the outrigger pontoons.

* * * * *